United States Patent [19]

Anthony

[11] 4,065,064

[45] Dec. 27, 1977

[54] LINERS FOR CRUSHER

[75] Inventor: James Anthony, Roanoke, Va.

[73] Assignee: Fuller Company, Catasauqua, Pa.

[21] Appl. No.: 733,963

[22] Filed: Oct. 19, 1976

[51] Int. Cl.[2] ..... B02C 2/00; B02C 17/22

[52] U.S. Cl. ..... 241/299; 241/182; 241/207; 241/300

[58] Field of Search ..... 241/182, 183, 207–216, 241/299, 300

[56] References Cited

U.S. PATENT DOCUMENTS

| | | | |
|---|---|---|---|
| 1,486,965 | 3/1924 | Janney | 241/209 |
| 2,275,992 | 3/1942 | Rahner | 241/183 |
| 2,409,391 | 10/1946 | Rumpel | 241/208 |
| 2,832,547 | 4/1958 | Kennedy | 241/216 X |
| 3,949,943 | 4/1976 | Schuler et al. | 241/299 X |

*Primary Examiner*—Roy Lake
*Assistant Examiner*—Howard N. Goldberg
*Attorney, Agent, or Firm*—Frank H. Thomson

[57] ABSTRACT

A wear resistant lining for the inside wall of the bottom shell of a gyratory crusher which includes a plurality of flat plates made out of wear resistant steel plate and having a generally trapezoidal shape and each having a pair of spaced apart holes therein. The plates are placed on the inside of the bottom shell of a gyratory crusher adjacent to each other to encircle the inside of the bottom shell. The holes in each plate are fitted with universal fittings which permit alignment of fasteners which pass through into a hole in the bottom shell of the crusher to enable the wear resistant plates to be secured to the inside of the shell.

4 Claims, 5 Drawing Figures

LINERS FOR CRUSHER

BACKGROUND OF THE INVENTION

The present invention relates to gyratory crushers and more specifically to a wear resistant lining for the bottom shell for a gyratory crusher which simplifies manufacturing of the crusher and specifically the placement of a wear resistant lining in the bottom shell of a gyratory crusher.

Gyratory crushers have been known for many years. Large gyratory crushers may include a top shell and a middle shell which together define the crushing chamber. A bottom shell is attached to the middle shell and defines an area below the crushing chamber which receives crushed rock and discharges it from the machine. The crushing chamber is, of course, provided with a wear resistant lining normally consisting of segments of cast manganese steel suitably mounted in the inside of the upper and middle shells. Some crushers, such as those used in crushing less abrasive materials such as certain limestones, do not have the inside of the bottom shell lined because the service is such that there is a minimum of wear of the bottom shell. If wear does occur, repair can be made by welding material onto the inside of the bottom shell, or by the addition of a material such as railroad rails or ultimately, by replacement of the bottom shell. Crushers which are subjected to more severe service, such as those used in mining abrasive materials such as copper and iron ores, often include a bottom shell which is lined with cast manganese steel segments similar to those which line the crushing chamber. The present invention relates to an improved lining for the bottom shell of a gyratory crusher which will replace the use of cast manganese steel liners used prior to the present invention.

Prior practice in lining the bottom shell of a large gyratory crusher consisted of using cast manganese segments with these segments being cast in a generally arcuate shape which is designed to conform to the conical shape of the bottom shell. Each of these segments is cast with a plurality of holes therethrough. In order to install the liners the segment is placed against the inside of the bottom shell, location of the hole in the segment is marked on the bottom shell and then the bottom shell is drilled to receive a fastener, which fastener is used to secure the lining segment to the inside of the bottom shell. The holes in the shell cannot be drilled according to predetermined measurements because the cast holes in the liner segments can shift from their intended position during the casting process. Several disadvantages result from this technique. When the manganese segments are cast and cooled, the actual configuration does not always conform to the intended configuration. The cooled segments do not always have the same radius as the radius of curvature of the bottom shell. This means that the cast segments of improper shape have to be corrected by heating and forming the segment thereby increasing costs. In addition, the holes through the shell are not always located exactly as planned because of operator error. Because prior practice requires drilling from the inside of the shell, it can be a noisy undesirable job for an operator, thus increasing the possibility of error. The entire operation of lining the bottom shell of a large gyratory crusher is a "cut and fit" operation and takes a substantial number of man hours.

In addition to the above problems with prior techniques for lining the bottom shell of a gyratory crusher, the use of cast segments had additional problems. For each bottom shell size, the liner segments will have a different configuration, either radius of curvature or dimensions. This means that for each bottom shell size, there must be a complete set of expensive patterns made to enable casting of the proper size liner segments. These patterns must be maintained as long as it is desired to be able to supply replacement liners.

Each time a bottom shell of a given size is cast, the finished casting will have a slightly different configuration from the previously cast shell made from that pattern. This is inherent in casting techniques. This change in slight configuration means that the lining segment patterns must be adjusted in configuration to each new shell. This increases costs and the amount of time required to construct both the liner segments themselves and the completed, lined shell.

By the present invention, an arrangement has been designed whereby the bottom shell of a gyratory crusher may be lined with a wear resistant steel plate cut to the desired dimensions rather than using cast segments. These plates may be provided with a pair of holes drilled or burned therethrough and the bottom shell itself may be drilled from the outside with the holes located by measurement in a conventional manner rather than by actually placing the lining plates in the bottom shell and then drilling from the inside of the bottom shell.

SUMMARY

It is therefore the principal object of this invention to provide a novel lining plate for use in lining the bottom shell of a gyratory crusher.

It is another object of this invention to provide a wear resistant lining for the bottom shell of a crusher which will reduce manufacturing costs of the lining and reduce installation costs of the lining.

It is a still further object of this invention to provide a novel wear resistant lining for the bottom shell of a crusher which will permit an increase in the quality of replacement liner parts.

In general, the foregoing and other objects will be carried out by providing for use in lining the inside of the bottom shell of a crusher wherein the bottom shell is in the form of a hollow truncated cone, a substantially flat, trapezoidal shaped, wear resistant plate including means for permitting the plate to be secured to the inside of the bottom shell of a crusher.

BRIEF DESCRIPTION OF THE DRAWINGS

The invention will be described in connection with the annexed drawings, wherein.

DESCRIPTION OF THE PREFERRED EMBODIMENTS

Figure 1:
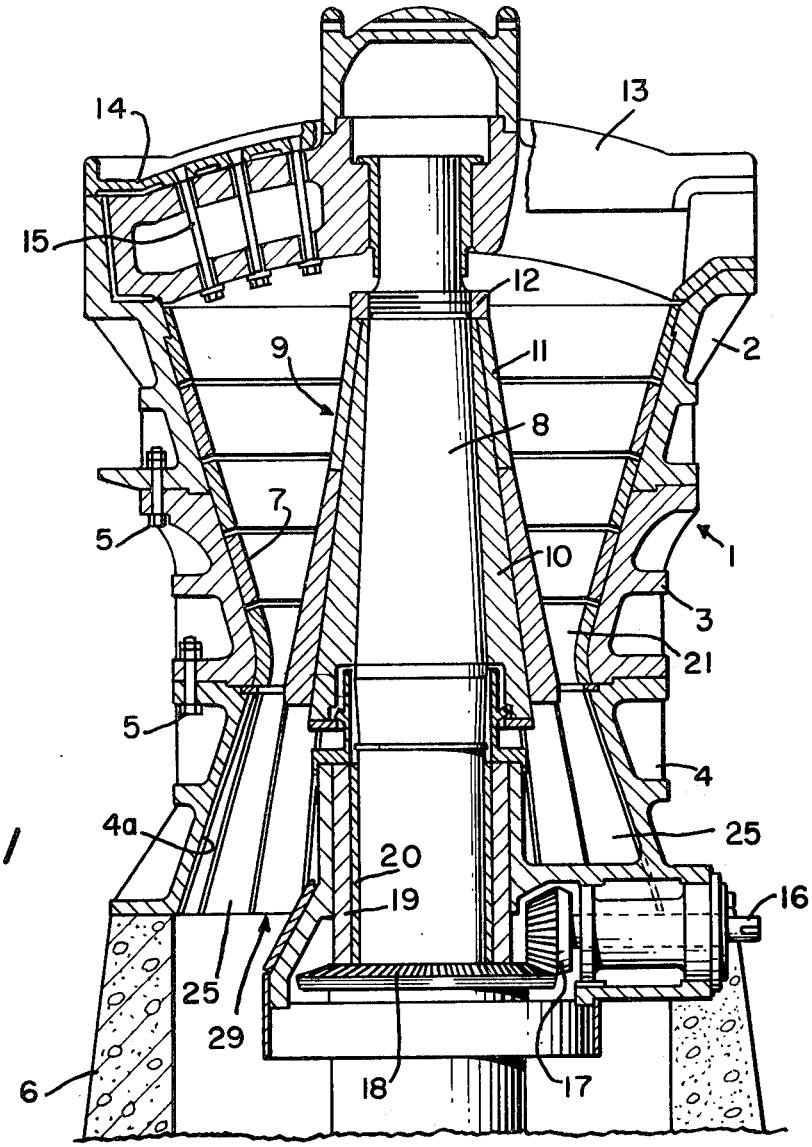
FIG. 1 is a sectional view of a gyratory crusher which employs the present invention.

Referring to FIG. 1, there is shown a typical gyratory crusher, generally indicated at 1, which includes a top shell 2, a middle shell 3 and a bottom shell 4 having an inner wall 4*a*. The top shell 2, is secured to the middle shell 3, and the middle shell is secured to the bottom shell 4 by means of suitable fasteners such as bolts 5. The entire crusher may be supported on a suitable foundation 6. The top shell 2 and middle shell 3 are lined with cast manganese wearing material 7 in a well known manner.

The crusher includes a main shaft 8 with a head generally indicated at 9 and including a head core 10 mounted on the main shaft 8. A mantle 11 of wear resistant material such as cast manganese steel is secured to the head core 10 by means of a head nut 12. The main shaft is suspended within the crusher 1 by a spider 13 with suitable fasteners (not shown) or by suitable hydraulic support (not shown) in the frame, all in a well known manner. Wear resistant material 14 may cover the top of the spider 13 and be secured thereto by bolts 15.

The crusher includes a countershaft 16 driven by a suitable motor (not shown). A drive pinion 17 is mounted on the countershaft 16 and meshes with a driving gear 18. An eccentric 19 is connected to the driving gear 18 and surrounds the main shaft 8. A bushing 20 is positioned between the eccentric 19 and the main shaft 8. A crushing chamber 21 is defined by the top shell 2 and middle shell 3 and more specifically between the lining 7 and the wear resistant cover 11 of the head 9. In a well known manner, as the countershaft 16 is driven, the eccentric 19 is rotated by gear 18. This causes the main shaft and connected head 9 to gyrate within the top and middle shells about an axis with spider 13 causing stone within crushing chamber 21 to be crushed as the head approaches and moves away from the crusher shell defined by top shell 2 and middle shell 3.

Stone which is crushed in chamber 21 will fall through the crusher and through bottom shell 4. When a crusher is subjected to severe service such as in copper and iron ore mining operations, stone within bottom shell 4 will be thrown around and against the inside of the bottom shell 4 causing wear. In order to prevent severe wear of the bottom shell itself, it has been known to line the bottom shell 4 with a suitable wear resistant material such as segments of cast manganese steel. When these segments become worn beyond acceptable limits, they must be replaced. By the present invention, a novel means for lining the inner wall 4*a* of the bottom shell has been devised.

Figure 2:
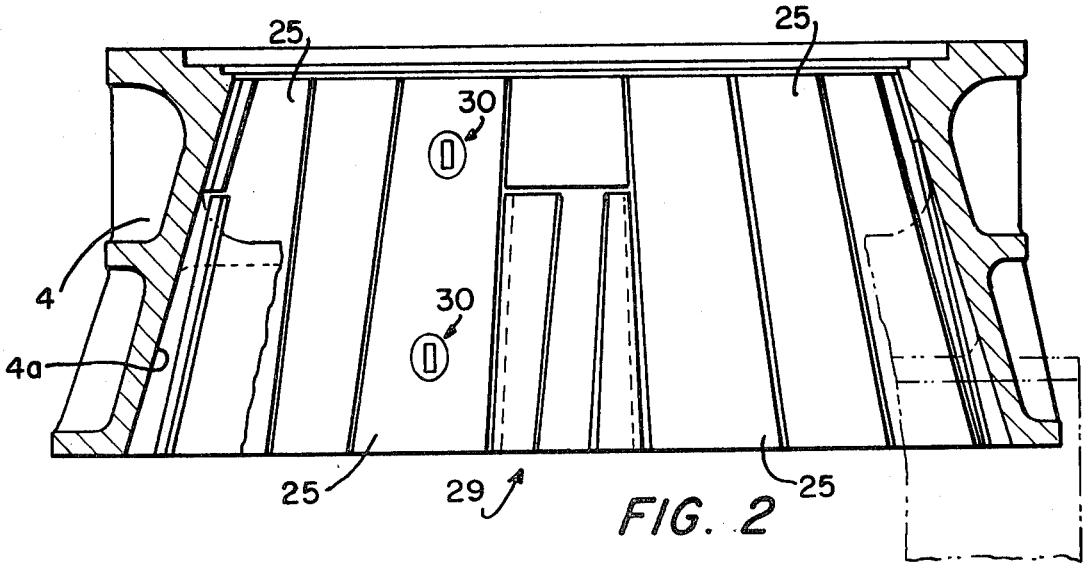
FIG. 2 is a sectional view of the bottom shell of a gyratory crusher employing the present invention.
Figure 3:
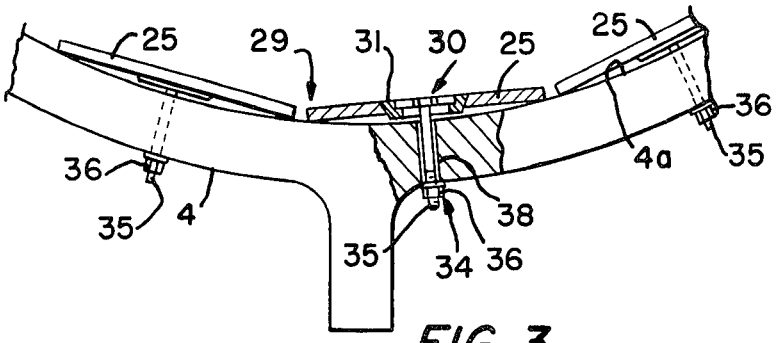
FIG. 3 is a fragmentary view partially in section of the bottom shell of a gyratory crusher.

Referring to FIGS. 2 to 5, the novel lining of the present invention includes a plurality of flat plates which are cut from flat wear resistant plate such as rolled steel plate. These flat plates are generally designated at 25 and are generally trapezoidal in shape. Each of the plates includes means for permitting the plate 25 to be secured to the shell 4 such as a pair of holes 26. The holes 26 have tapered or conical sides 27. The plates 25 are to be secured to the inside 4*a* of the bottom shell 4 adjacent to each other as shown in FIGS. 2 and 3 to encircle the inside of the bottom shell to thereby form a complete lining 29. The trapezoidal shape permits complete encirclement of the truncated conical inside of the bottom shell.

A universal fitting generally indicated at 30 is provided to be positioned within each of the holes 26 for securing the plate 25 to the shell 4. This universal fitting 30 includes a conical disc 31 having an elongated slot 32 therethrough which is countersunk at 33. A plurality of fastener means 34 including bolts 35 and nuts 36 are provided with each fastener means 34 being operatively associated with one of the universal fittings by passing through the slot 32 into and through one of a plurality of holes 38 in the bottom shell 4.

Figure 5:
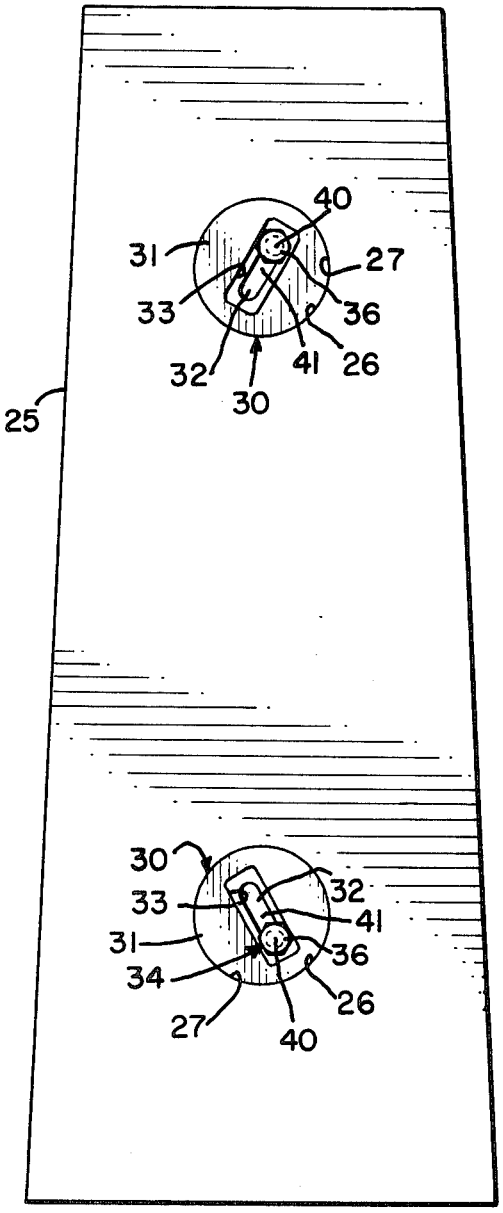
FIG. 5 is a view of one of the lining segments of the present invention.
Figure 4:
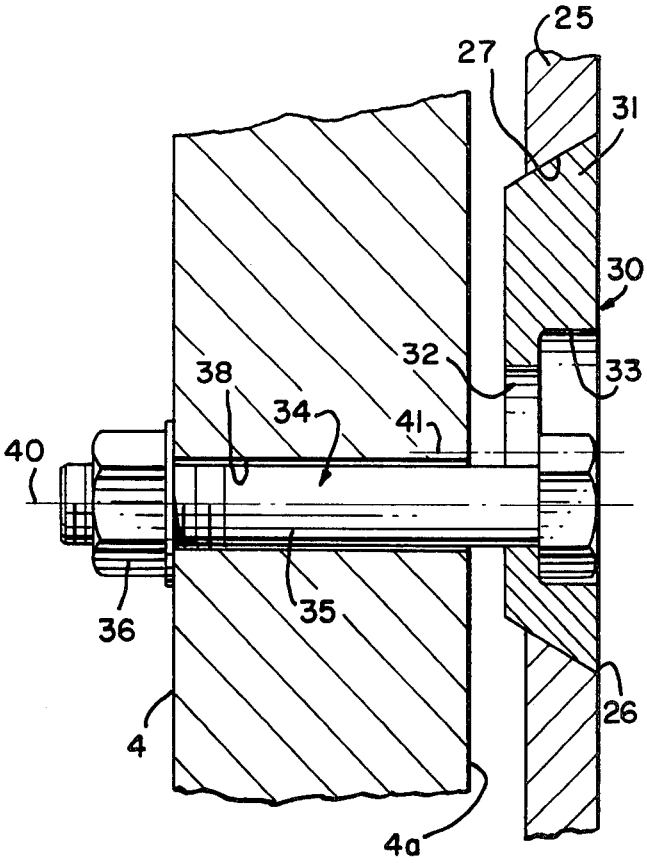
FIG. 4 is a sectional view of a portion of the bottom shell showing the apparatus for fastening the lining of the present invention to the bottom shell.

The universal fitting 30 permits placement of the lining segment 25 even if the holes 38 are not exactly aligned with the holes 26. Referring to FIGS. 4 and 5, this feature of the invention is best shown. If the axis of the hole 38 is considered to be line 40 and the axis of the hole 26 is considered to be line 41, then it can be seen from FIGS. 4 and 5 that the hole 26 need not be aligned with the hole 38. The universal fitting 30 or disc 31 may be rotated relative to the plate 25 and the fastener means 34 may be moved in slot 32 to permit the securing of the plate 25 to the shell 4 even if the holes are not properly aligned. If the hole 38 is not perpendicular to the shell 4 or the axis 40 of hole 38 is not parallel to axis 41 of hole 26, the tapered walls 27 of the hole 26 and the conical sides of the disc 31 compensate for this deficiency and insure that the bolt 35 will hold the plate 25 unto the shell 4.

In assembly of the lining to the shell 4, after the plates 25 are cut from stock, the holes 26 can be burned or drilled therein. At the same time the holes 38 in the shell 4 can be located by measurement and drilled. The plates 25 can then be secured to the inside of the shell 4 by use of the universal fittings 30 and fastener means 34. Even if the holes 26 and holes 38 are misaligned, the plates can be used. This will eliminate wastage of improperly drilled plates. Each plate need not be individually fit to the inside of the shell before the hole in the shell for securing the lining plates 25 is drilled. Because the wear resistant lining plates 25 are made from flat wear resistant material, there is no lost manufacturing or assembly time due to improper casting or undesired deformation during cooling. The total of these features results in a substantial reduction in cost. There is a further cost reduction when it becomes necessary to replace the lining 29 due to wear. Plates 25 can be manufactured to original specifications and dimensions and they will fit as long as reasonable tolerances are maintained.

From the foregoing it should be apparent that the objects of this invention have been carried out. A crusher lining has been provided which substantially reduces the cost of manufacturing by reducing the cost of assembly time.

It is intended that the foregoing be merely a description of a preferred embodiment and that the invention be limited solely by that which is within the scope of the appended claims.

I claim:

1. A wear resistant lining for the bottom shell of a crusher wherein the inside of the bottom shell is a hollow generally truncated cone comprising:

a plurality of wear resistant plates each mounted on the inside of the bottom shell of the crusher adjacent to each other, to thereby encircled the inside of the bottom shell;

each of said plates being substantially flat and having at least one hole therethrough;

a plurality of fastener means, each operatively associated with one of the holes in said plates and the bottom shell of the crusher for securing said plate to the inside of the bottom shell; and a plurality of universal fittings, each adapted to be positioned in one of the holes in said plates;

each of said fastener means being operatively associated with one of the universal fittings for securing its associated fitting in its respective hole in said plate.

2. A wear resistant lining for the bottom shell of a crusher according to claim 1 wherein the bottom shell of the crusher includes a plurality of holes therein, each generally aligned with the holes in said wear resistant plates, and said holes in said plates are tapered and said universal fitting includes a disk means having a slot therein and said fastener means extends through said slot and into a hole in said bottom shell.

3. A wear resistant lining for the bottom shell of a crusher according to claim 2 wherein each of said plates is generally trapezoidal in shape and is made from wear resistant steel.

4. A wear resistant lining for the inside of a crusher comprising:

a plurality of wear resistant plates, each mounted on the inside of the crusher;

each of said plates having at least one hole therethrough;

a plurality of fastener means; and a plurality of universal fittings, each adapted to be positioned in one of the holes in said plates;

each of said fastener means being operatively associated with one of the universal fittings and the crusher for securing its associated fitting in its respective hole in the plate and for securing said plate to the inside of the crusher.

* * * * *